US005466938A

United States Patent [19]

Nakayama et al.

[11] Patent Number: 5,466,938

[45] Date of Patent: Nov. 14, 1995

[54] CORONA DISCHARGE DEVICE

[75] Inventors: Yasunori Nakayama; Noboru Yonekawa; Kouji Matsushita; Yasuhiro Nakagami; Shizuo Yuge, all of Toyokawa, Japan

[73] Assignee: Minolta Co., Ltd., Osaka, Japan

[21] Appl. No.: 314,086

[22] Filed: Sep. 28, 1994

[30] Foreign Application Priority Data

Sep. 30, 1993 [JP] Japan ..... 5-245158
Feb. 25, 1994 [JP] Japan ..... 6-027120

[51] Int. Cl.[6] ..... H01T 19/04; G03G 15/02

[52] U.S. Cl. ..... 250/326; 355/224; 355/225; 361/229; 361/230

[58] Field of Search ..... 250/324, 325, 250/326; 355/224, 225; 361/229, 230

[56] References Cited

U.S. PATENT DOCUMENTS 3,358,289 12/1967 Lee ..... 250/325
3,691,373 9/1972 Compton et al. ..... 250/49.52 C
4,591,713 5/1986 Gundlach et al. ..... 250/326
4,725,731 2/1988 Lang ..... 250/326
4,792,680 12/1988 Lang et al. ..... 250/325

FOREIGN PATENT DOCUMENTS 60-80870 5/1985 Japan ..... 355/224

*Primary Examiner*—Jack I. Berman
*Attorney, Agent, or Firm*—Willian Brinks Hofer Gilson & Lione

[57] ABSTRACT

Grid wires arranged in an axial direction of a photoconductive drum have a positional relation with projecting electrodes arranged at regular intervals in an axial direction of the photoconductive drum at a position opposite to the surface of the photoconductive drum wherein the grid wires and the projecting electrodes positioned adjacent to each other are equally arranged in distance to uniformly discharge an electric charge to the surface of the photoconductive drum from each of the projecting electrodes so that uniform charging can be accomplished in an axial direction of the photoconductive drum.

14 Claims, 15 Drawing Sheets

DISCHARGE DEVICE OF THE PRESENT INVENTION

DISCHARGE DEVICE OF COMPARATIVE EXAMPLE 1

CORONA DISCHARGE DEVICE

BACKGROUND OF THE INVENTION

1. Technical Field of the Invention

The present invention relates to a corona discharge device which is utilized for charging the surface of a photoconductor of an electrostatic image forming apparatus to a desired potential.

2. Description of Related Art

A corona discharge device has heretofore been utilized as a charging device for charging the surface of a photoconductor of an image forming apparatus such as copying machines and printers to a desired potential.

There are a variety of corona discharge devices such as a wire discharge type device using a wire electrode, and a pin-array discharge type device wherein a plurality of projecting electrodes such as needle-shaped electrodes or sawtooth electrodes are used. In the case of the pin-array discharge system, the amount of ozone generation is smaller compared with the wire discharge system. In recent years, the pin-array discharge type of device is, therefore, being used widely, and a variety of this type of devices have been proposed.

However, there is a problem in the pin-array discharge system that a photoconductor is not charged uniformly in a direction of line since discharge electrodes are spaced at a predetermined distance in an axial direction of the photoconductor and a discharge is carried out concentratively from the tip end of the projecting electrode. An irregular charge causes blurring of an image in an image forming operation and lowers the quality of the image.

In order to solve such a problem of irregularity in charging, it has been devised to provide the projecting electrodes farther away from the surface of the photoconductor, or to make a distance between each of the projecting electrodes smaller by increasing the number of electrodes. However, there still remains a problem that a charging effect is lowered in the former, and in the case of the latter, the amount of substance generated by discharge is increased. Thus, the advantage of the pin-array discharge device is offset eventually.

For the same object, a scorotron discharge system is adopted to perform a corona discharge toward a member to be charged from projecting electrodes through a grid electrode wherein the grid electrode controlled under a constant voltage is arranged between the surface of a photoconductor and the portion where tips of the projecting electrodes are aligned. However, there still remains a problem that in order to obtain uniformity in charging in a practical use, the total amount of current needs to be increased necessitating a further improvement. A problem is further observed that there occurs irregularity in a charging process since a foreign substance is adhered to the tip of the electrodes, and the tip is rounded off as it changes with the passage of time.

SUMMARY OF THE INVENTION

A primary object of the present invention is to provide a corona discharge device which is capable of charging the surface of a photoconductor uniformly with efficient charging capability, the device being a pin-array system corona discharge device which generates only a little amount of substance by discharge.

Another object of the present invention is to provide a pin-array system corona discharge device wherein uniformity in charging is not impaired with the passage of time.

These and other objects and features of the present invention will become more apparent from the following description taken in conjunction with the accompanying drawings which illustrate specific embodiments of the invention.

DESCRIPTION OF THE PREFERRED EMBODIMENTS

Description will now be made hereinafter on some embodiments of the present invention referring to accompanying drawings.

Figure 1A:
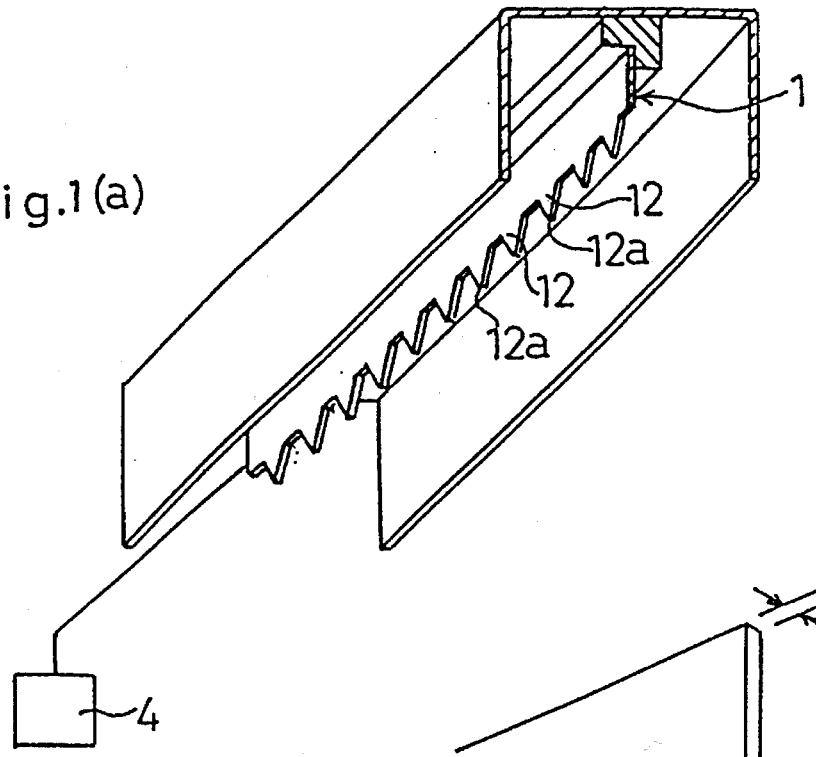
FIGS. 1(*a*), 1(*b*) and 1(*c*) are perspective views showing discharge members which are applied to a corona discharge device of a first embodiment of the present invention.
Figure 1B:
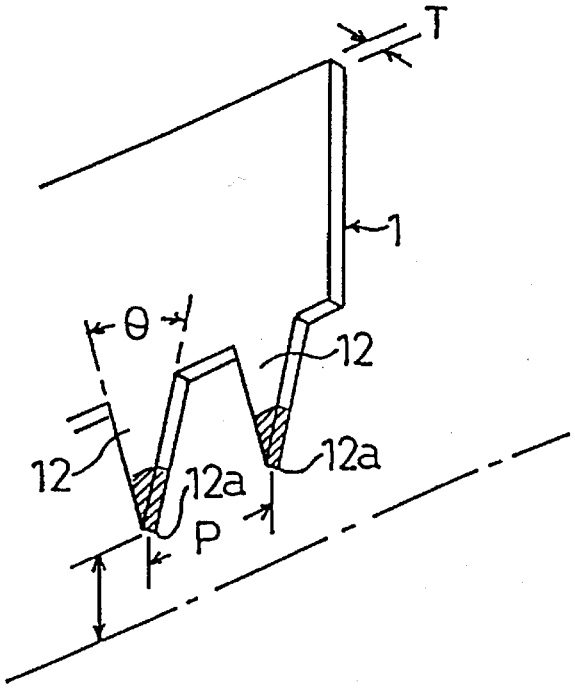
Figure 1C:
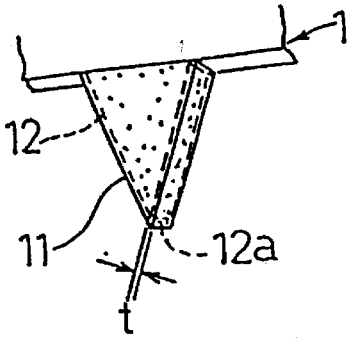

FIG. 1 shows discharge members which are applied to a corona discharge device of the present invention as a first embodiment. As shown in FIG. 1(*a*), a discharge member 1 is provided with a power source 4 connected therewith. The discharge member 1 is combined with a grid electrode 6 to be used as a scorotron discharge device 10 as shown in FIG. 4(*c*) wherein a construction of the first embodiment of the present invention is illustrated.

Figure 4A:
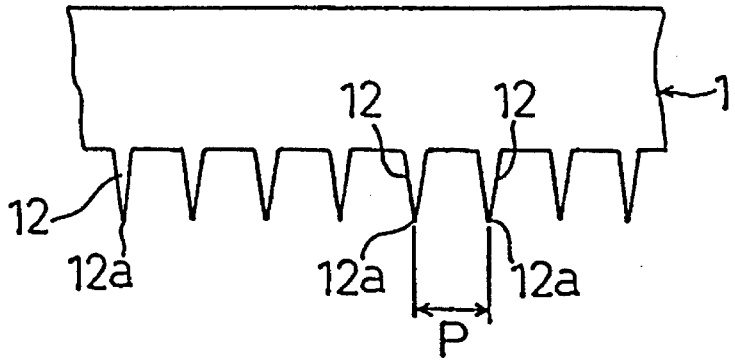
FIGS. 4(*a*), 4(*b*) and 4(*c*) are views showing discharge members and grid electrodes which are applied to the first embodiment of the present invention as well as the entire construction of a corona discharge device wherein the discharge member and the grid electrode are combined.
Figure 4B:
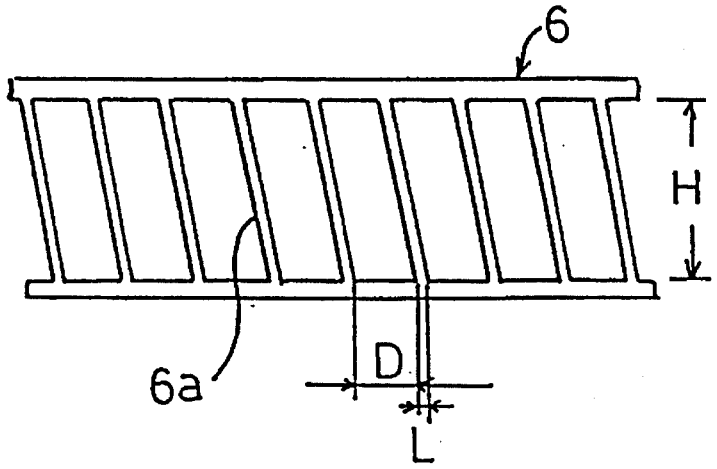
Figure 4C:
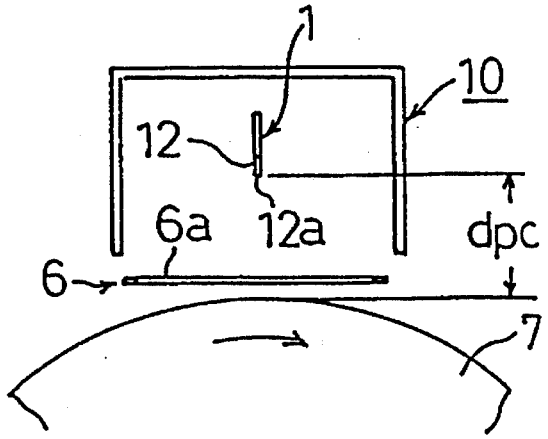

The discharge device 10 is incorporated in an electrophotographic image forming apparatus to uniformly charge the surface of a photoconductive drum 7(see FIG. 4(*c*) which is a member to be charged prior to forming an electrostatic latent image.

In the discharge member 1, projecting electrodes 12 having sharp discharge ends 12*a*, generally defining a sawtooth shape, are integrally provided at one end of an electrode plate as shown in FIG. 1(*a*) and FIG. 4(*a*) along the surface of the photoconductive drum 7 with a predetermined pitch P in an axial direction of the drum as illustrated in FIG. 4(*a*). Each of the projecting electrodes 12 discharges an electric charge from its respective discharge end 12*a* by an applied voltage from a power source 4 which is provided to be applied to the discharge member 1 for discharging process.

Figure 2A:
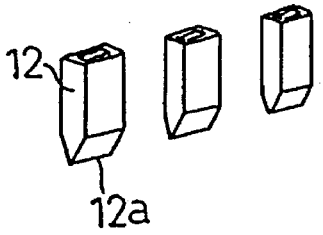
FIGS. 2(*a*), 2(*b*) and 2(*c*) are perspective views showing portions of projecting electrodes of various kinds of modified discharge members shown in FIG. 1.
Figure 2B:
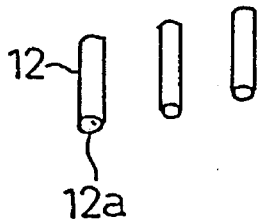
Figure 2C:
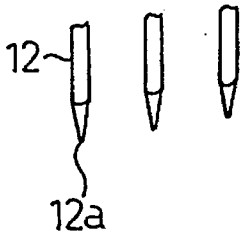

Such a sawtooth discharge member 1 can be easily obtained by a roll press working or by an etching process which is an example adopted by the present invention. Various kinds of discharge members 1 may also be considered. For instance, a razor-edge shaped discharge end 12*a* as shown in FIG. 2(*a*), or a wire discharge end 12*a* as shown in FIG. 2(*b*) or a needle-shaped discharge end 12*a* illustrated in FIG. 2(*c*) may also be adopted.

A further detailed description will now be made on the discharge member 1 applied to the first embodiment of the present invention shown in FIG. 1. It is preferable to set an angle of tooth θ of each sawtooth in each projecting electrode 12 below 15° since the amount of ozone generation is increased as the angle of tooth increases. An angle of the tooth below 30° may be permissible though. On the contrary, if an angle of the tooth is too small, problems arise in the strength and workability of the tooth. It is, therefore, desirable to set the angle more than 5°. An angle ranging from 5° to 15° is thus most preferable.

A thickness of a plate to be used for the sawtooth projecting electrode 12 may be set under 0.1 mm, preferably about 0.05 mm, since the amount of ozone generation becomes smaller when the thickness of the plate is set thinner. However, if the thickness is too thin, it causes an insufficient strength.

The tip portion of the projecting electrode 12 of the discharge member 1 which includes a discharge end 12*a* shown by oblique lines in FIG. 1(*b*) is oxidized and dust is adhered thereto when a corona discharge is performed to cause an irregularity in discharging. It is, therefore, desired to restrain the oxidation and prevent the dust adhesion to provide the electrode with durability so that a stabilized discharge can be performed. An improvement in durability can be accomplished by improving corrosion resistance and thermal resistance. The use of an alloy iron containing chrome and nickel is considered favorable for a conductive member which forms the discharge end 12*a* from the viewpoint of thermal resistance and corrosion resistance. It may also be arranged to contain molybdenum therein in order to further improve the thermal resistance and corrosion resistance.

The ratio of component to be contained may be arranged with a range of 16–20% for chrome, preferably 16–18%, and 8–15% for nickel, preferably 10–14%. Excessive use of the components causes hardness and tensile strength to be impaired with an increase in manufacturing cost.

When molybdenum (Mo) is used, a ratio of about 2–3% is considered preferable. If it is contained excessively, electric resistance is increased to burden the power source 4. For the discharge member 1, a copper conductive member which is treated for corrosion resistance with nickel plating, for instance, may also be considered other than the material described above.

The projecting electrode 12 of the discharge member 1, especially at least the tip portion which includes the discharge end 12*a*, may be covered with a material 11 which possesses high electric resistance characteristics such as a ceramic conductive material as illustrated in FIG. 1(*c*). Ceramic materials are favorably used for such a conductive member, among which glass, silicon oxide ($SiO_2$), silica, silica alumina, alumina and the like are preferable.

In this case, the thickness of a covering t is to be set under 0.1 mm, preferably under 0.01 mm, since a dielectric voltage becomes large if the thickness is set excessively large, and causes a spark to be easily generated. For the covering, methods of vapor deposition, material covering, or covering a material with a tube may properly be adopted.

Figure 3:
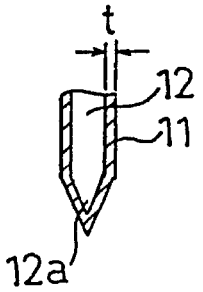
FIGS. 3(*a*), 3(*b*) and 3(*c*) are perspective views showing other kinds of modified discharge members shown in the FIG. 2 wherein portions of each of projecting electrode are covered.
Figure 3B:
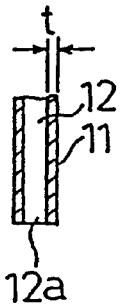
Figure 3:
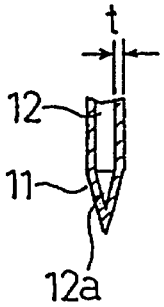

Whatever shape a discharge end 12*a* is provided with the projecting discharge electrode 12 in a discharge member 1 as illustrated in FIG. 2, the same effect can be accomplished by covering the tip portion of the projecting electrode 12 including at least a discharge member 1 with an electrically high resistant material shown in FIG. 3.

The power source 4 connected with the discharge member 1 should be one to which a discharge voltage which includes at least a component of AC voltage can be applied in order to reduce the amount of ozone generation, and for an improvement in discharge stability. When the frequency of an applying AC voltage becomes higher, the amount of ozone generation becomes less, however, a frequency is to be set within a range from 400 Hz to 1.5 KHz since leakage current increases when the frequency is made higher. When the sum of components of a discharge current between plus and minus sides approaches zero, the amount of ozone generation becomes less, and therefore, the sum of components of a current is set within a range of −200 μA—+100 μA.

A grid electrode 6 is spread like a net, or formed by punching a plate member. As illustrated in FIG. 4(*b*), a grid wire 6*a* is arranged in a direction parallel to an arrangement of the projecting electrode 12 shown in FIG. 4(*a*). It may be easily obtained, for instance, by stretching a conductive wire on a conductive frame, or by etching or press working a thin conductive metal plate in mesh.

An opening ratio of the grid electrode 6 is provided based on a ratio between a metal occupying area in an effective portion of the grid electrode and a vacancy area. As to a mesh grid electrode, for instance, an opening ratio may easily be given by D/(D+L) where D is a width of opening in a longitudinal direction of the grid electrode and L is a width of wire of the grid wire 6 (refer to FIG. 4(*b*)).

When an opening ratio is too low, sufficient electric charge cannot be given to a member to be charged such as a photoconductive drum 7, and charging efficiency is lowered. On the contrary, if the opening ratio is excessively high, a charge compensating capability is lowered since a leakage current to a member to be charged such as a photoconductive drum is increased. If a width of grid opening D is too large, it is not preferable since an irregularity in charging potential is induced for a member to be charged, such as a photoconductive drum.

In the case when a wire electrode is used as a discharge electrode of a scorotron corona discharge device, it is not necessary for a grid electrode to regulate the position of a grid wire in its longitudinal direction. In other words, the wire electrode discharges uniformly in a longitudinal direction of the grid electrode so that the grid wire only needs to be arranged at predetermined regular intervals. It is not necessary for the grid wire to be positioned at a specified location in a longitudinal direction of the grid wire.

When the projecting electrodes 12 having various kinds of sharp discharge ends 12*a* are used in a corona discharge device 10 of the present invention as illustrated in FIGS. 1 through 3, no consideration has been given to a positional relation between the discharge end 12*a* of the projecting electrode 12 and the grid wire 6*a* of the grid electrode 6 in a conventional device. The grid wire had only been arranged at an equal pitch.

In other words, the positional relation between each of the projecting electrodes 12 and the grid electrode 6 adjacent to said projecting electrode 12 is not the same with respect to the positional relations between other projecting electrodes 12 and grid electrodes 6. Under such a state, a uniform electric field over a longitudinal direction of the grid electrode 6 cannot be obtained, and therefore, there occurs irregularity in discharge current in a direction the projecting electrodes 12 of the discharge member 1 are arranged, for instance, in a longitudinal direction of the discharge member 1 of the present invention. Even if it does not affect an image at the initial stage, irregularity in discharge current is gradually worsened in a change of the projecting electrode and environment with the passage of time, and causes the image to blur.

Experiments have been conducted by the inventors of the present invention on the matters described above, and it was found that the irregularity is caused by adhesion of silicone or the like to the projecting electrode, and corrosion and deformation of the tip portion of the projecting electrode. It was further found that there occurs irregularity in discharge since the tip portion of a projecting electrode is rounded off as it changes with the passage of time.

Description will now be made on a behavior in discharge action when dust, silicone or the like is stuck to the electrode, and in the case when the electrode is deformed.

If there is an electrode which is not able to discharge well among a plurality of projecting electrodes due to adhesion of dust, silicon or the like, and deformation of the electrode, the power of an electric field around the electrode is weakened. When the power of the electric field is weakened, the power of the electric field on an electrode adjacent to said electrode is strengthened, and causes it to easily discharge. Further, for an electrode adjacent to said electrode where the electric field is strengthened, the power of electric field is weakened to cause a difficulty in discharge. Since the electric fields of electrodes adjacent to each other are interfered with, irregular electrodes are distributed, i.e., an electrode which is able to easily discharge and an electrode which is not able to discharge well.

When a grid wire is positioned adjacent to the tip of an electrode which is able to discharge easily, a potential on the surface of a member to be charged is made high, however, it does not become excessively high. If, however, a grid wire is not positioned adjacent to the tip of an electrode which is able to easily discharge, a potential on the surface of a member to be charged is made excessively high.

Figure 12:
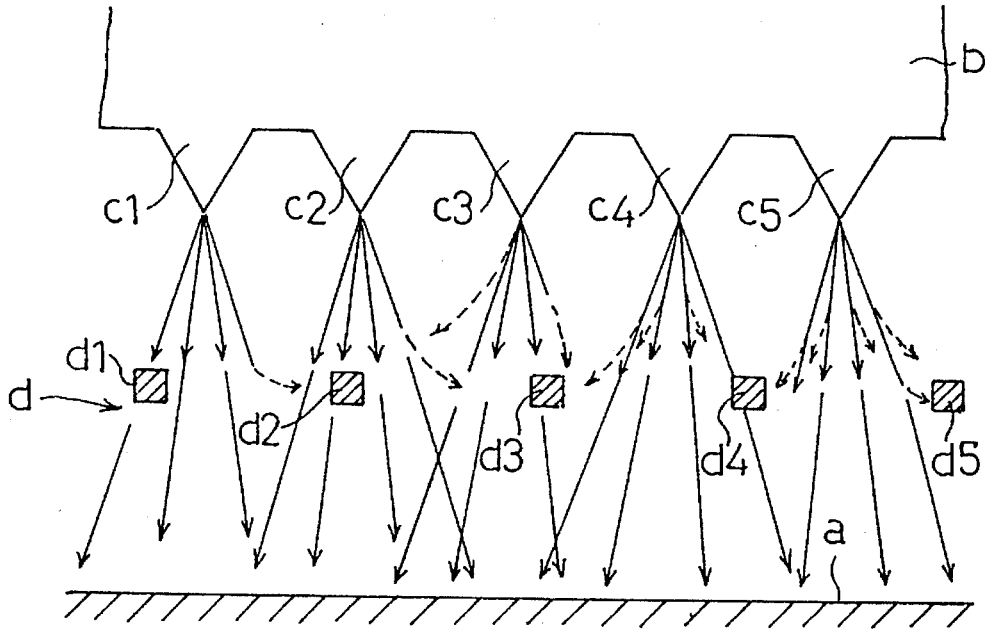
FIG. 12 is an explanatory view showing a state of normal discharge in a corona discharge device of comparative example 2.

FIG. 12 shows an example of a conventional pin-array discharge device as comparative example 2. Projecting electrodes c1–c5 . . . of a discharge member b positioned opposite to a member to be charged a are arranged at regular intervals in a longitudinal direction. In a grid electrode d which is provided between the member to be charged a and the discharge member b, grid wires d1–d5 . . . are arranged at regular intervals in a direction the projecting electrodes c1–c5 are arranged. The intervals each of the projecting electrode c1–c5 faces to each adjacent grid wire d1–d5 differ. For instance, the distance between the projecting electrode c3 and grid wire d3 is smaller than the distance between the projecting electrode c5 and grid wire d4 or d5.

Discharge from the tip of each of the projecting electrodes c1–c5 is made in a symmetrical spread as shown by arrows of solid line. When there is a big difference in VO and VG, a discharged electric charge easily approaches a member to be charged a through a grid wire d1–d5 which is controlled to a constant potential VG. When a potential VO of a member to be charged a approaches a potential VG of a grid wire d1–d5, a discharge potential from each projecting electrodes c1–c5 is easily pulled near toward each grid wire d1–d5 positioned adjacent to each other by a charge pulling force on the side of a member to be charged as shown by arrows of broken line in FIG. 12. When the tip of each of the projecting electrodes c1–c5 is not stuck with dust, silicon or the like, and is not rounded off under a predetermined potential of a member to be charged a and grid electrode c, the member to be charged a is charged in a manner to have a small ripple in high and low.

If, however, when the tip of the projecting electrodes c1–c5 is stuck with dust, silicone or the like, and is rounded off, there arise problems of causing irregular charge by said interference of electric field, and distribution of irregular electrodes, i.e., an electrode which discharges sufficiently and an electrode which cannot discharge sufficiently.

When the distance between a projecting electrode and a grid wire facing adjacent to the electrode is large, a potential difference between the portions with high potential and low potential in a member to be charged becomes excessively large. If, however, the distance between a grid wire and a facing electrode which discharges a large amount is small, a potential difference between the portions with high potential and low potential in a member to be charged becomes small compared with the case when the distance is large.

Figure 13:
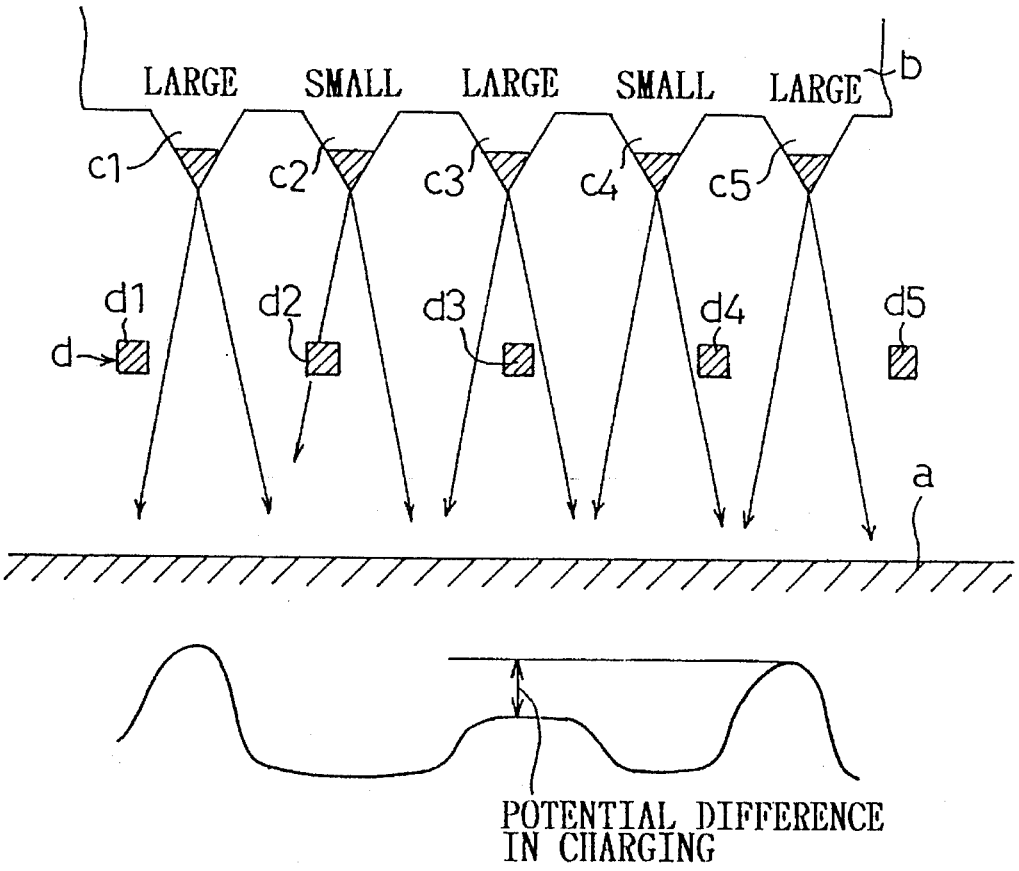
FIG. 13 is an explanatory view showing a state of discharge when excessive electric charge is generated in a corona discharge device of comparative example 2.

FIG. 13 shows a condition of the comparative example 2. When the amount of discharge of the projecting electrode c1, c3, c5 became large by said interference of electric field, for instance, an excessive charge discharged from a projecting electrode c5 approaches a member to be charged so as to cause large potential difference between the portions with high potential and low potential, and the charge is not pulled to the grid wire easily. Since the distance from a projecting electrode c3 to a grid wire d3 is small, an excessive charge discharged from the projecting electrode d3 approaches a member to be charged so as to cause a small potential difference between the portions with high potential and low potential, and the charge is hard to be pulled to the grid wire as compared with the projecting electrode c5.

Corresponding to a change in distance between each of the projecting electrodes c1, c3, c5 which discharges a large amount of electric charge and each grid wire d1–d5 adjacent to the respective electrodes, there occurs a difference in pulling force between a charge discharged from the projecting electrodes c1, c3, c5 and a pulling force of each grid wire d1–d5, and a problem of irregularity cannot be solved to cause a large potential difference between the portions in high potential and low potential in a member to be charged a.

In order to solve such a problem, in a scorotron corona discharge device which is provided with a plurality of projecting electrodes 12 of discharge member 1 arranged at regular intervals, and a grid electrode 6 having grid wires 6*a* arranged adjacent to the portions where the tips of said plurality of projecting electrodes 12 are arranged in the same direction, the present embodiment is arranged to provide the same positional relation between the tip of a projecting electrode 12 of discharge member 1 and a grid wire 6*a* adjacent to the electrode.

In the scorotron discharge device 10, a positional relation between a discharge end 12*a* which is the tip of each projecting electrode 12 and a grid wire 6*a* adjacent thereto is arranged to be the same with respect to any other projecting electrodes so that an electric charge discharged from each projecting electrode 12 is equally and sufficiently pulled toward a grid wire 6*a* to be supplied to the grid electrode 6. Even if dust, silicone or the like is adhered to the tip of each projecting electrode 12 of the discharge member 1, and the tip is rounded off to cause distribution of irregular electrodes by the interference of electric field, each of the projecting electrodes 12 which discharges in large amount is provided with a grid wire 6*a* adjacent thereto in an equal positional relation, and excessive current from each projecting electrode 12 is equally pulled to be supplied to a grid electrode by each grid wire 6*a* positioned adjacent thereto. A distribution of charging potential by each electrode which discharges in large amount is thus made substantially the same to reduce irregularity in discharge.

In the comparative example 2, an electric charge discharged from each electrode which discharges in large amount is pulled toward a grid wire differently, and therefore, a distribution of charging potential by said electrode differs. It was unable to reduce irregularity in discharge since potential difference between high and low portions differs on each electrode which discharges in large amount. However, such a difficulty can be solved by the present invention.

According to experiments conducted by inventors of the present invention, it was found that such an irregularity in discharging current and blurriness of image caused by irregularity in discharge can be prevented by an arrangement which satisfies the following equation (1) where P is a pitch of discharge ends 12*a*, D a mesh opening width in a longitudinal direction of a grid electrode 6, L a line width of a grid wire 6*a* and n is an integer representing a relation among them.

$$\frac{P}{(D+L)} = n \tag{1}$$

where,

P: Interval of projecting electrodes

D: Interval of grid wires

L: Width of grid wire n: Integer (=1, 2, 3, . . . )

Figure 5:
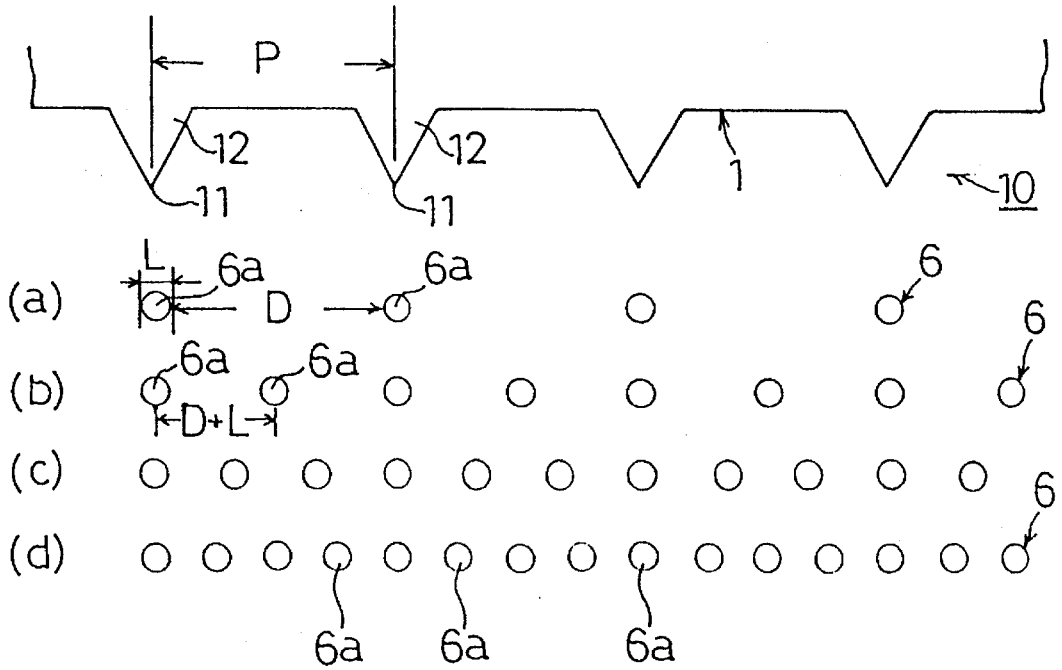
FIG. 5 is an explanatory view showing each design sample of corona discharge device to be applied to the devices shown in FIG. 4.
Figure 6:
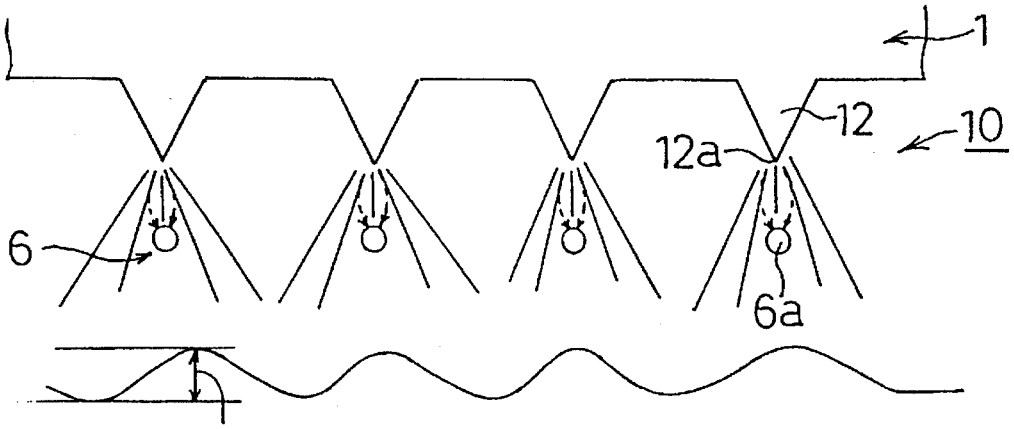
FIG. 6 is an explanatory view showing a state of discharge under the construction shown in FIG. 5(*a*).
Figure 7:
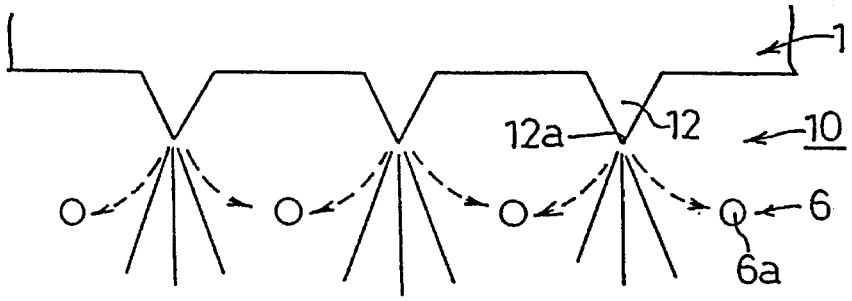
FIGS. 7(*a*) and (*b*) are explanatory views showing a state of discharge under two arrangements of constructions other than the construction shown in FIG. 5.
Figure 7:
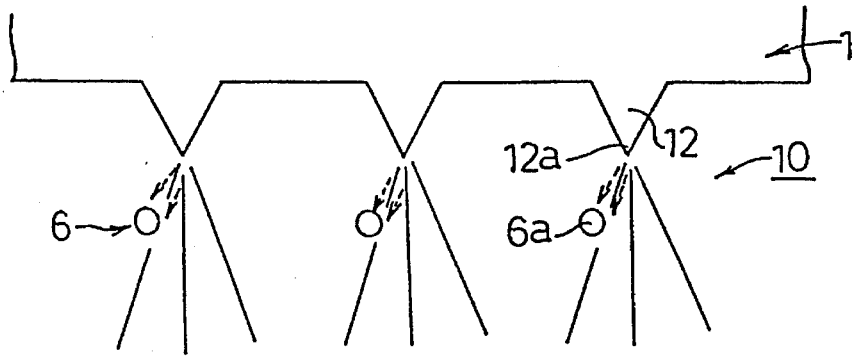

By setting a pitch of arrangement of the projecting electrode 12 and grid wire 6 as stated in the equation (1), a positional relation between a projecting electrode 12 and a grid wire 6*a* which is adjacent to the electrode 12 becomes the same as the ones illustrated in FIGS. 5 and 7. Therefore, even if dust, silicone or the like is adhered to a pointed end which includes a discharge end 12*a* of the projecting electrode 12, and the pointed end is rounded off in a change with the passage of time causing irregularity in discharge from each of the projecting electrodes 12, an electric charge toward a grid wire 6*a* and an electric charge toward a member to be charged not through a grid wire 6*a* do not differ on each of the projecting electrodes 12 as shown by arrows of solid and broken lines in FIGS. 6 and 7. Even though there occurs interference of electric field in a change with the passage of time, the irregularity in discharge can be reduced.

As shown in FIGS. 6 and 7, an arrangement of the projecting electrode 12 and an arrangement of the grid wire 6*a* are made at regular intervals as a consequence. The relation of an interval between those two arrangements may be set at 1:integral multiples, and (b), (c) and (d) in FIG. 5 show cases when a multiple is increased.

In the case of examples shown in FIGS. 5 and 6, the projecting electrode 12 and each grid wire 6*a* are positioned opposite to each other on a perpendicular line. In the case of examples shown by (a) and (b) in FIG. 7, however, the projecting electrode 12 and each grid wire 6*a* do not face each other on a perpendicular line. In the example shown by (a) in FIG. 7, each one of the grid wires 6*a* faces a middle position between each one of the projecting electrodes 12. In the example shown by (b) in FIG. 7, each one of the grid wires 6*a* faces a position to one side of each one of the projecting electrodes 12.

In the example of (a) shown in FIG. 7, it is preferable to make a distance between a projecting electrode 12 and a grid wire 6 smaller so that an excessive charge from the projecting electrode 12 may easily be supplied to each one of the grid wires 6*a* positioned adjacent to both sides of the electrode 12.

In the above-described construction of the present invention, irregularity in discharge which causes blurriness of image does not occur. If an interval between each one of the grid wires 6*a* is made smaller, an irregularity in discharge caused by the interference of electric field can effectively be reduced, like the examples shown in the FIG. 5, wherein (b) is smaller than (a), (c) is smaller than (b), and (d) is smaller than (c) in the distance of intervals between each one of the grid wires 6*a*.

Figure 8:
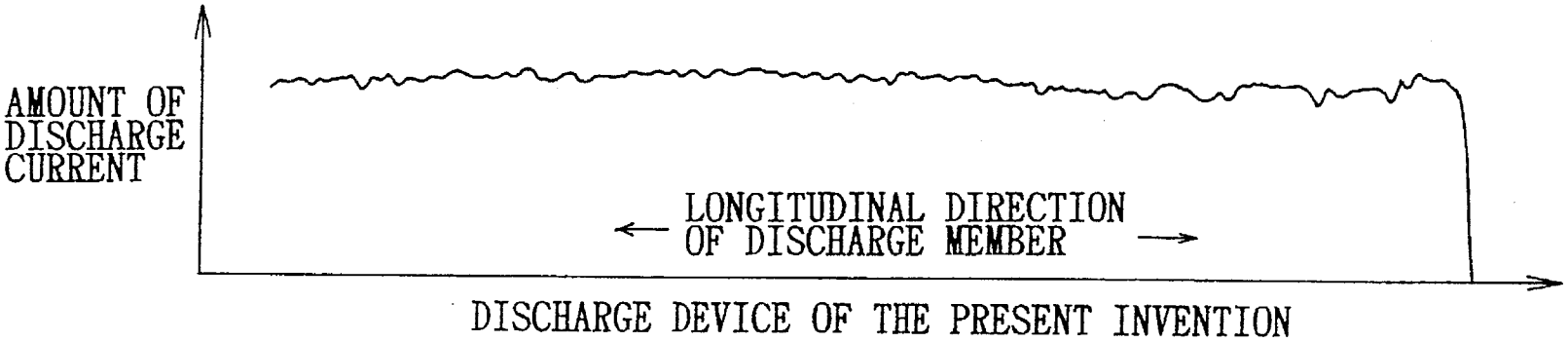
FIG. 8 is a graph showing how irregularity in discharge is generated in a discharge device of the present invention.
Figure 9:
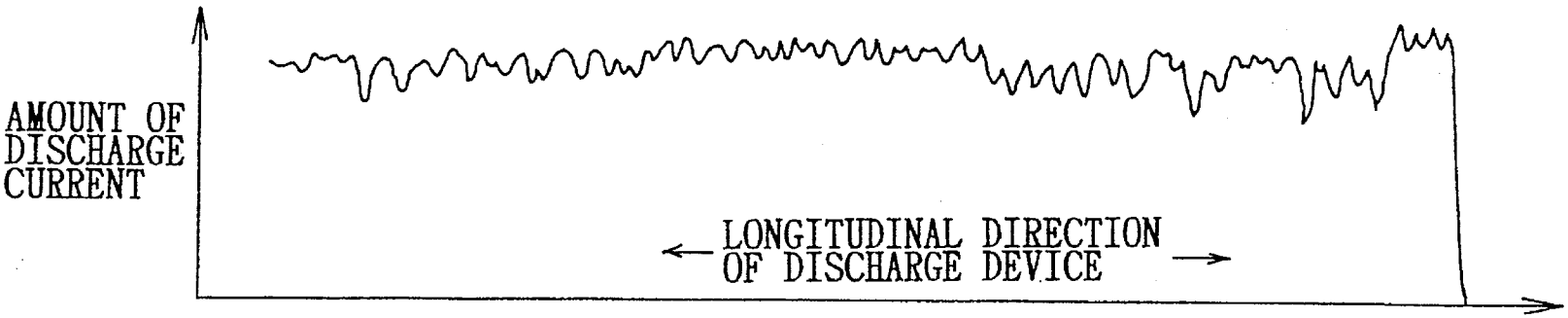
FIG. 9 is a graph showing how irregularity in discharge is generated in a discharge device of comparative example 1.

FIGS. 8 and 9 show how an irregularity in discharge can be effectively restrained with reference to a comparative example 1. In an experiment, two corona discharge devices were used, i.e. a device which is provided with the same construction as the present invention and a conventional discharge device of the comparative example 1.

| | Discharge Device of Present Invention | Discharge Device of Comparative Example 1 |
|---|---|---|
| Pitch P at discharge end | 2 mm | 2 mm |
| Discharging gap d p c | 10 mm | 10 mm |
| Opening width D of grid | 0.8 mm | 1 mm |
| Width L of grid wire | 0.2 mm | 0.2 mm |
| Effective Width H of grid | 22 mm | 22 mm |
| Perpendicular position of discharge end | All on grid wire | Not uniform |

As for an irregularity in discharge current, after each discharge device has been discharged for 100 hours, a discharge current flowing from each projecting electrode 12 toward a photoconductive drum 7 which is a member to be charged is detected under an environment of low temperature and low density, and if the detected discharge current is found irregular along a longitudinal direction of the discharge member 1, it is determined as an irregular discharge current.

When a comparison is made between the case where a discharge device of the present invention is used as illustrated in FIG. 8 and the case where a discharge device of the comparative example 1 is used as shown in FIG. 9, it is observed that there occurs a larger irregularity in discharge in the case of the comparative example 1 against which irregularity in discharge is substantially reduced in the case of the device of the present invention. The difference in irregularity in discharge current corresponds to the difference in blurriness of image when an image sample is collected. It is found that when the discharge device of the present invention is used, an image of high quality is obtained compared with the case when the device of the comparative sample 1 is used.

An irregularity in discharge is affected by a ratio of distance between a photoconductive drum 7 which is a member to be charged and a discharge member 1, i.e. a ratio of a discharging gap dpc to a value of n given by the above-stated equation. When said ratio is small, an irregularity in discharge is made small, and it enables a device to be manufactured compactly. If, however, a device is manufactured too small, it is not preferable since a charge compensating efficiency is lowered, and an abnormal discharge occurs. Therefore, it is preferable to arrange a corona discharge device of the present invention in such a way to satisfy the equation (1) and the following equation (2).

$$2 \leqq \frac{dpc(D+L)}{P} \leqq 8 \qquad (2)$$

where, dpc: discharging gap

Figure 10:
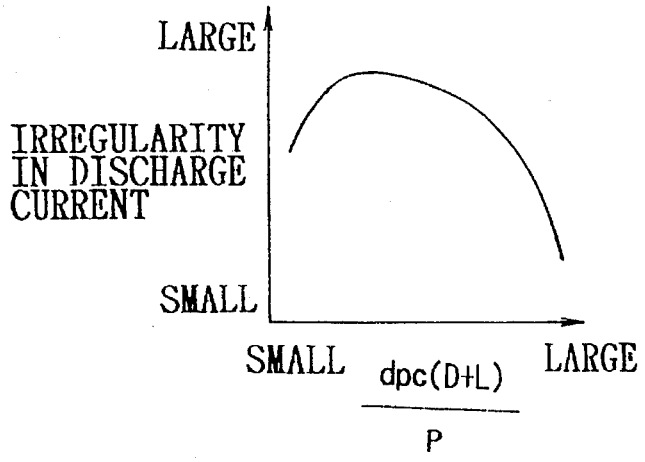
FIG. 10 is a graph showing a relation between a discharge current irregularity and a ratio of dpc to n.

FIG. 10 shows a relation between an irregularity in discharge current and dpc with a value n. If an upper limit which is given by the equation (2) is exceeded, an electrode voltage becomes large since a distance between a projecting electrode 12 and a grid wire 6*a* is made large. Further, since a pitch of grid wire 6*a* becomes large, an irregularity in discharge easily occurs. Moreover, since a pitch of projecting electrode 12 becomes small, electric fields generated by projecting electrode 12 interfere with each other to result in distributing an irregular amount of electric charge among projecting electrodes 12, i.e., a projecting electrode 12 which discharges a large amount of electric charge, a projecting electrode 12 which discharges a small amount of electric charge.

On the contrary, if a lower limit given by the equation (2) is exceeded, a discharge is made only locally causing an irregularity in discharge since a distance between a projecting electrode 12 and a grid wire 6*a* is small. Since a pitch of grid wires 6*a* is small, electrode voltage becomes large. Further, since a pitch of projecting electrode 12 becomes large, there occurs an irregularity in discharge.

Efficiency of a grid electrode 6 is affected by a shape of the grid electrode itself. It is also affected by a relative velocity of movement V to a photoconductive drum 7 which is a member to be charged. It is preferable to arrange a grid electrode to satisfy the following equation (3) wherein an opening width in a longitudinal direction of a grid electrode 6 is expressed as D, and a width of the grid wire 6*a* as L, and an effective width in a direction of movement relative to a photoconductive drum 7 which is a member to be charged by the grid electrode 6 as H.

$$0.01 \leqq \frac{D}{D+L} \times H \times \frac{1}{V} \leqq 0.05 \qquad (3)$$

where, $$\frac{D}{D+L} :$$

Opening ratio of grid electrode

H: Width of grid electrode

V: Circumferential speed of photoconductive drum

Figure 11:
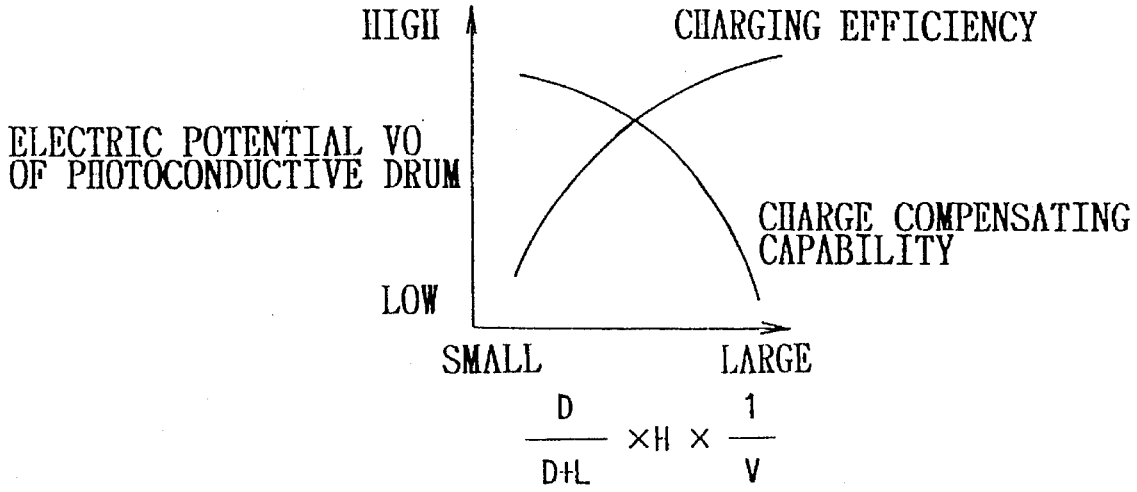
FIG. 11 is a graph showing a relation between an electric potential VO of a photoconductive drum and a ratio of D,L,H to V.

FIG. 11 shows a relation between an electric potential VO of a photoconductive drum 7 and D, L, H with V. If an upper limit given by the equation (3) is exceeded, there easily occurs an irregularity in discharge since an opening ratio of a grid wire 6 becomes large. Further, since a width of the grid electrode is made large, it necessitates manufacture of a discharge device large in size, and an electrode current is eventually increased. A circumferential speed of the photoconductive drum 7 as a member to be charged is made small, however, there is not any particular problem on this matter.

On the contrary, if a lower limit given by the equation (3) is exceeded, an electric potential VO of the photoconductive drum 7 as a member to be charged is not stabilized since an opening ratio of the grid electrode 6 is made small. Since a width of the grid electrode 6 becomes small, an electric charge to reach the photoconductive drum 7 is small, and a charging capability is made small. Further, since a circumferential speed is made large, a charging capability is made small.

Figure 14:
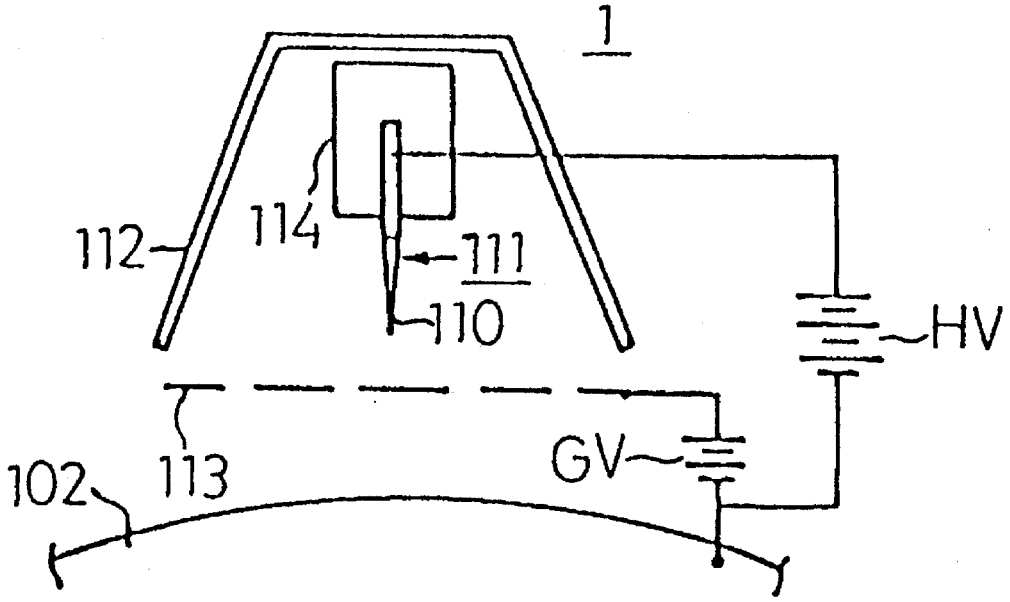
FIG. 14 is a front sectional view showing a construction of a corona discharge device which is applied to a second embodiment of the present invention.

FIG. 14 shows a corona discharge device in a second embodiment of the present invention. A charging device in the second embodiment comprises an electrode 111 wherein projecting electrodes 110 are spaced in an axial direction of a photoconductive drum 102, a stabilizing plate 112 for stabilizing a discharge from the projecting electrodes 110, and a grid electrode 113 provided between the projecting electrodes 110 and the photoconductive drum 102.

The electrode 111 is mechanically held by a holding member 114 and is electrically connected with a base plate of the photoconductive drum 102 through a high voltage power source HV. The grid electrode 113 is electrically connected with a base plate of the photoconductive drum 102 through a grid power source GV. In the present invention, the electrode 111 is integrally formed by cutting a sheet of metal plate into a plurality of projecting electrodes 110 in a sawtooth shape. However, it may also be arranged to form an electrode 111 wherein projecting electrodes 110 are manufactured separately and arranged in one dimension as an electrode to be electrically connected.

Figure 15:
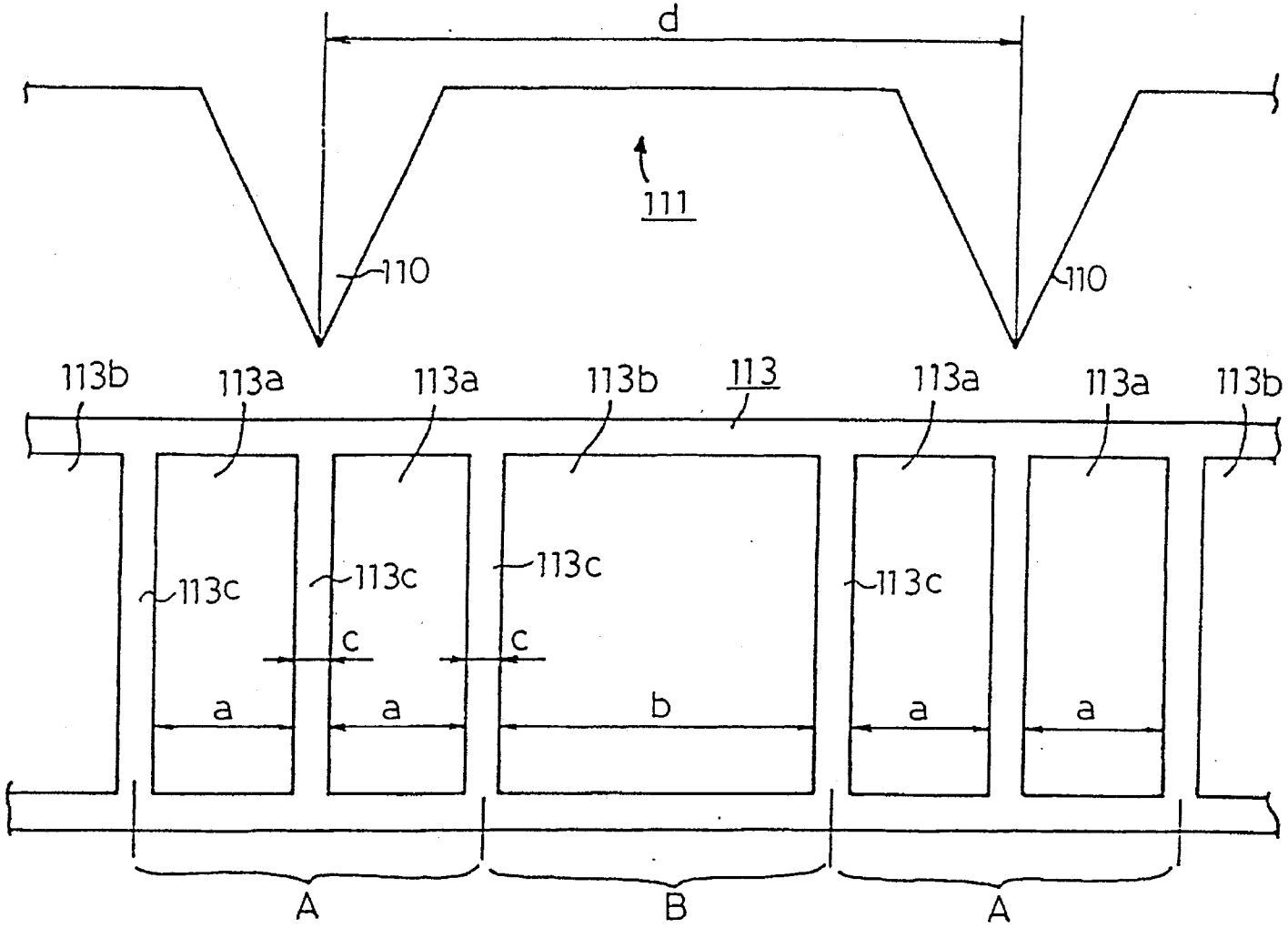
FIG. 15 is a view showing a construction of electrode and grid electrode applied to the device shown in FIG. 14 relative to an axial direction of a photoconductor 2.

FIG. 15 shows a construction of an electrode 111 and a grid electrode 113 provided in an axial direction of a photoconductive drum 102. For convenience in describing the figure, the electrode 111 is shown in a side view, and the grid wire 113 in plan view, respectively. Projecting electrodes 110 of an electrode 111 are arranged in an axial direction of the photoconductive drum 102 with a space d=2.0 (mm). In the grid electrode 113, opening sections 113*a* and 113*b* are formed in a longitudinal direction, and widths a and b of the opening sections 113*a*, 113*b* in a longitudinal direction are periodically changed simultaneously with a space d of the projecting electrodes 110.

More particularly, the width a of the opening section 113*a* adjacent to a position opposite to a projecting electrode 110 is set at 0.4 (mm), and the width b of an opening section adjacent to a position opposite to the middle of the projecting electrode 110 and 110 is set at 0.9 (mm). In the figure, c represents a width of a grid wire 113*c* of the electrode 113 and is set at 0.1 (mm). In other words, in said grid electrode 113, when a ratio of the area of opening sections 113*a* and 113*b* to the entire area of the grid is let to represent an opening ratio, an opening ratio of A section adjacent to a position opposite to the projecting electrode 110 is about 80%, and an opening ratio of B section adjacent to a position opposite to the middle of the projecting electrodes 110 and 110 is about 90%.

Figure 16:
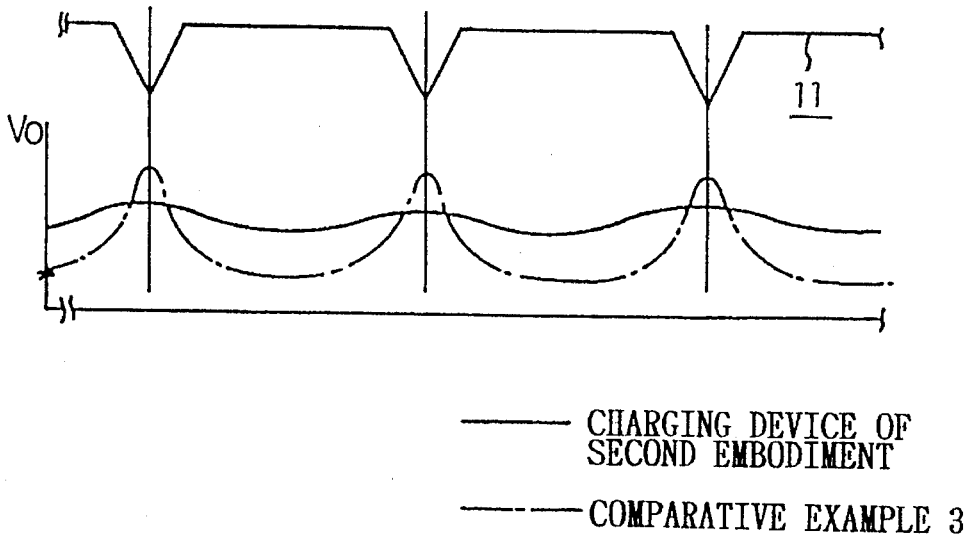
FIG. 16 is a diagram showing the result of an experiment conducted on charging by a corona discharge device.
Figure 17:
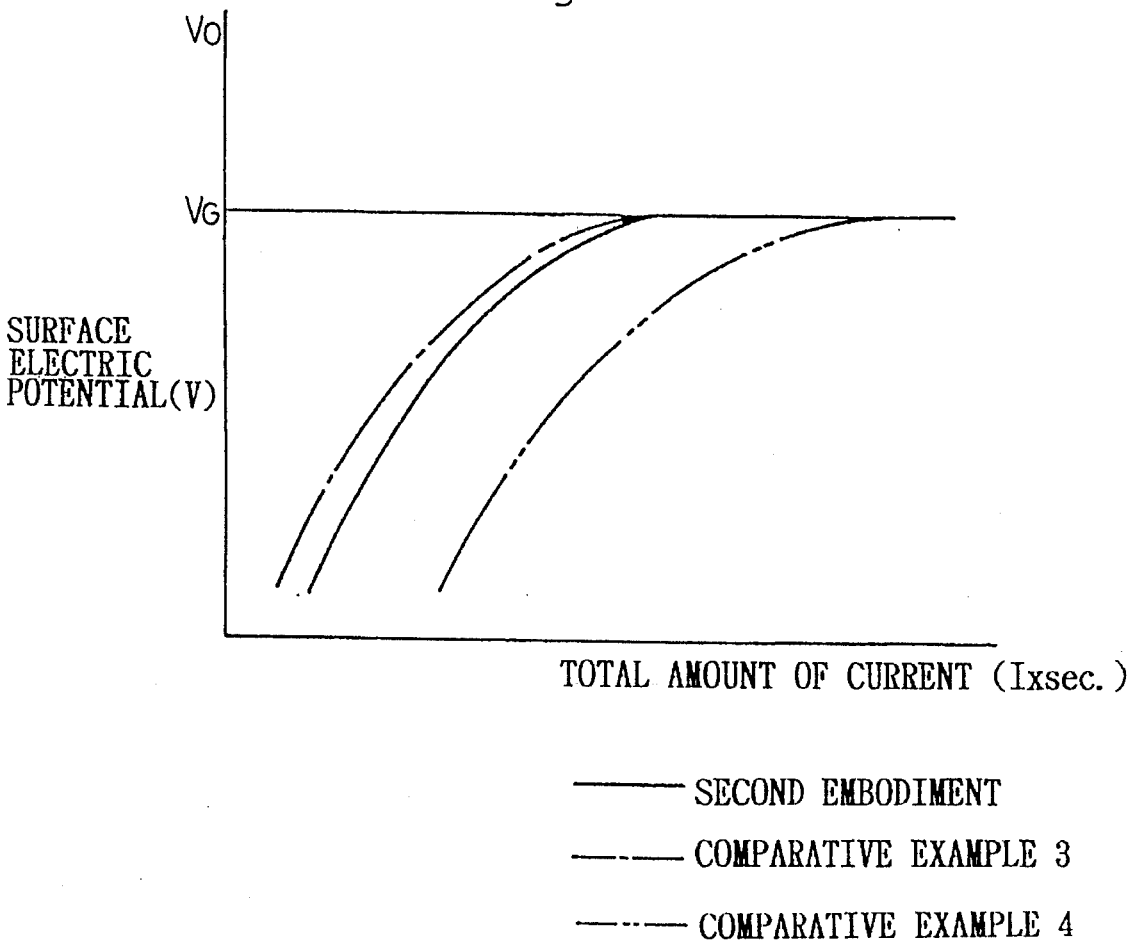
FIG. 17 is a diagram showing the result of an experiment conducted on charging by the corona discharge device shown in FIG. 14.
Figure 18:
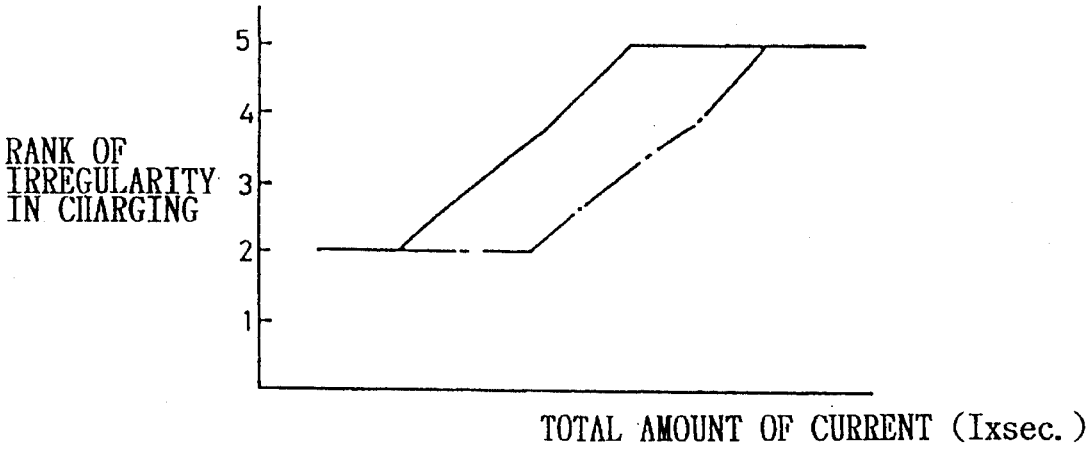
FIG. 18 is a diagram showing the result of an experiment conducted on charging by the corona discharge device shown in FIG. 14.

FIGS. 16 through 18 show a result of an experiment conducted wherein the surface of a photoconductive drum 102 is charged by using a charging device of the present embodiment. As a comparative example 3, a charging device provided with projecting electrodes 110 to which a conventional grid electrode is applied is shown by one-dotted chain line, and as a comparative example 4, a charging device provided with wire electrodes to which a conventional grid electrode is applied is shown by two-dotted chain line.

The grid electrodes used in both comparative examples 3 and 4 are provided with a width of grid of 0.1 (mm), and a width of opening section is 1.0 (mm). The opening ratio is equally about 90% with respect to a longitudinal direction of the photoconductive drum 102. The charging devices used in the comparative examples 1 and 2 are provided with high voltage power source HV and grid power source GV similar to the charging device 1 of the present invention. To each one of the charging device 1 of the present invention, and the charging devices used in the comparative samples 3 and 4, 5–6 (kV) is applied to the high voltage power source HV, and 600 (V) is applied to the grid power source GV for conducting a comparative experiment.

FIG. 16 shows a state of occurrence of irregularity in charging process in a longitudinal direction of a photoconductor 2 when a charging experiment is conducted under the conditions described above. The vertical line denotes a surface potential $V_o$ of a photoconductive drum 2, and the transverse shows a longitudinal direction of the photoconductive drum 102. As is clear from the diagram, in the case of the charging device of the comparative example 3, a remarkable irregularity in charging occurs corresponding to an arrangement of projecting electrodes 110, 110, . . .

More particularly, a surface potential adjacent to a position opposite to the projecting electrode 110 is high, and a surface potential adjacent to a position opposite to the middle of the projecting electrodes 110 is low. On the other hand, in the case of the charging device of the present embodiment, uniform charging is performed with respect to an axial direction of the photoconductive drum 102 irrespective of the positions the projecting electrodes 110, 110, . . . are arranged. By arranging the grid electrode 113 as described above, a discharge toward an adjacent position opposite to the projecting electrode 110 is restrained in the surface of the photoconductive drum 102, and at the same time, a discharge toward an adjacent position opposite to the middle of the projecting electrodes 110 and 110 is activated.

FIG. 17 shows a relation between a charging potential of a photoconductor and a total amount of electric current supplied from a high voltage power source when a charging experiment is conducted under the conditions described above. The vertical line denotes a surface potential $V_o$ of a photoconductive drum 102 and the transverse a total amount of current applied from the high voltage power source HV respectively. As is clear from the diagram, a total amount of current required for charging the photoconductive drum 102 to a desired level is a little larger than the charging device used in the comparative example 3 when compared with the charging device of the present embodiment, however, about 30% of current can be restrained when compared with the charging device used in the comparative example 4.

FIG. 18 shows a relation between a rank in irregularity in charging and a total amount of current when a charging experiment is conducted under the conditions described above. The vertical line denotes a rank in evaluating irregularity in charging and the transverse denotes a total amount of current applied from a high voltage power source HV, respectively.

Evaluation which has been made on irregularity in charging process is ranked as follows.

Rank 5: There is no problem in practical use.

Rank 4: There is little problem in practical use.

Rank 3: Limits for practical use.

Rank 2: There is a problem for practical use.

Rank 1: There is a remarkable problem for practical use.

As is clear from the diagram, in the charging device of the present embodiment, a photoconductor 2 is charged uniformly with a smaller amount of current compared with the charging device used in the comparative example 3. In other words, compared with the charging device of the comparative example 3, consumption of electric energy for the high voltage power source HV can be reduced.

In the charging device described above, a ladder shaped grid is applied as a grid electrode 113, however, if its opening ratio can vary in synchronization with the space of arrangement of projecting electrodes 110, such a grid may also be applied to the present invention, for instance, a grid provided with a mesh opening section.

In summary, in a charging device of the present embodiment, a discharge to a photoconductor is restrained since an opening ratio of grid electrode is made smaller adjacent to a position opposite to a discharge electrode. On the other hand, a discharge is activated at an adjacent position opposite to the middle of needle-shaped electrodes. In consequence, the problem of irregularity in charging process which occurs in a longitudinal direction of a photoconductor can be solved, and at the same time, generation of a substance which is created by discharge is decreased with satisfactory charging efficiency.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A corona discharge device used in an image forming apparatus to apply a uniform charge to an image bearing surface, comprising:

a discharge member having a plurality of projecting discharge ends;

a voltage power source adapted to supply energy to said discharge member; and a screen member placed between said discharge member and said image bearing surface and having a plurality of grid wires arranged in a longitudinal direction, wherein a positional relation between any one of said plurality of projecting discharge ends and adjacent grid wires is the same as a positional relation between any other of said plurality of discharge ends and adjacent grid wires.

2. A corona discharge device as claimed in claim 1, wherein said grid wires and discharge ends are spaced at regular intervals, and a ratio between a pitch in arrangement of the discharge ends and a pitch in arrangement of the grid wires is 1: a multiple of an integer.

3. A corona discharge device as claimed in claim 1, wherein the grid wires are disposed opposite to the projecting discharge ends.

4. A corona discharge device as claimed in claim 1, wherein a space between the grid wires is narrow at an adjacent position opposite to the discharge ends, and a space between the grid wires is wide at an adjacent position opposite to a location between the discharge ends.

5. A corona discharge device as claimed in claim 4, wherein the grid wires are disposed opposite to the discharge ends.

6. A corona discharge device as claimed in claim 1, wherein said voltage power source applies to said discharge member a voltage containing an AC voltage component as well as a DC voltage component.

7. A corona discharge device used in an image forming apparatus to apply a uniform charge to an image bearing surface, comprising:

a discharge member having a plurality of sharp discharge ends, said discharge ends being disposed at regular intervals;

a voltage power source adapted to supply energy to said discharge member; and a screen member placed between said discharge member and said image bearing surface and having a plurality of grid wires arranged in a longitudinal direction, said grid wires being arranged at regular intervals in a relation of X=nY where X represents a space between the discharge ends, Y a space between grid wires, and n a natural number.

8. A corona discharge device as claimed in claim 7, wherein said voltage power source applies to said discharge member a voltage containing an AC voltage component as well as a DC voltage component.

9. A corona discharge device used in an image forming apparatus to apply a uniform charge to an image bearing surface, comprising:

a discharge member having a plurality of projecting discharge ends;

a voltage power source adapted to supply energy to said discharge member; and a screen member placed between said discharge member and said image bearing surface, said screen member having a plurality of grid wires arranged in a longitudinal direction, each of said wires corresponding to each of said discharge ends, respectively, a positional relation between any one of said discharge ends and a corresponding wire is the same as a positional relation between others of said discharge ends and corresponding wires.

10. A corona discharge device as claimed in claim 9, wherein a length between said any one of said discharge ends and a corresponding wire is the same as a length between said others of said discharge ends and corresponding wires.

11. A corona discharge device used in an image forming apparatus to apply a uniform charge to an image bearing surface, comprising:

a discharge member having a plurality of projecting discharge ends;

a voltage power source adapted to supply energy to said discharge member; and a screen member which is placed between said discharge member and said image bearing surface and has a plurality of openings, wherein a positional relation between any one of said discharge ends and adjacent openings is the same as a relation between others of said discharge ends and adjacent openings.

12. A corona discharge device as claimed in claim 11, wherein said openings of the screen member and discharge ends of the discharge member are spaced at regular intervals respectively.

13. A corona discharge device as claimed in claim 11, wherein said openings of the screen member are small at an adjacent position opposite to the discharge ends, and said openings of the screen member are large at a position opposite to a location between the discharge ends.

14. A corona discharge device as claimed in claim 11, wherein an opening ratio of said screen member at a position opposite to the discharge ends is smaller than an opening ratio at a position opposite to a location between the discharge ends.

* * * * *